US009249642B2

(12) United States Patent
Kolle

(10) Patent No.: US 9,249,642 B2
(45) Date of Patent: Feb. 2, 2016

(54) EXTENDED REACH PLACEMENT OF WELLBORE COMPLETIONS

(71) Applicant: Tempress Technologies, Inc., Kent, WA (US)

(72) Inventor: Jack J. Kolle, Seattle, WA (US)

(73) Assignee: TEMPRESS TECHNOLOGIES, INC., Renton, WA (US)

( * ) Notice: Subject to any disclaimer, the term of this patent is extended or adjusted under 35 U.S.C. 154(b) by 392 days.

(21) Appl. No.: 13/943,584

(22) Filed: Jul. 16, 2013

(65) Prior Publication Data

US 2013/0299196 A1 Nov. 14, 2013

Related U.S. Application Data

(63) Continuation-in-part of application No. 12/957,049, filed on Nov. 30, 2010, now Pat. No. 8,528,649.

(60) Provisional application No. 61/672,160, filed on Jul. 16, 2012.

(51) Int. Cl.

| | |
|---|---|
| ***E21B 23/08*** | (2006.01) |
| ***E21B 43/10*** | (2006.01) |
| ***E21B 23/04*** | (2006.01) |

(52) U.S. Cl.

CPC ..... *E21B 23/08* (2013.01); *E21B 23/04* (2013.01); *E21B 43/10* (2013.01)

(58) Field of Classification Search

CPC ..... E21B 21/10; E21B 23/08; E21B 43/10; E21B 34/16; E21B 37/00; E21B 43/25; E21B 34/10; E21B 23/04; F16K 31/122

See application file for complete search history.

(56) References Cited

U.S. PATENT DOCUMENTS

| | | | |
|---|---|---|---|
| 699,273 | A | 5/1902 | Wolski |
| 1,963,090 | A | 6/1934 | Jakosky |
| 2,342,732 | A | 2/1944 | Gudmundsen |

(Continued)

FOREIGN PATENT DOCUMENTS

| | | |
|---|---|---|
| DE | 1568680 | 6/1980 |

OTHER PUBLICATIONS

Borland et al., "Drill Bit Seismic, Vertical Seismic Profiling, and Seismic Depth Imaging to Aid Drilling Decisions in the Tho Tinh Structure Nam Con Son Basin—Vietnam." Butsuri-Tansa vol. 51, No. 1: 27-44, 1998.

(Continued)

*Primary Examiner* — Daniel P Stephenson

(74) *Attorney, Agent, or Firm* — Morgan, Lewis & Bockius LLP

(57) ABSTRACT

A self-actuated cyclical flow interruption valve on a deployment tool is positioned at a proximal end of a well completion assembly. Fluid is pumped though the self-actuated cyclical flow interruption valve and vented immediately distal of the valve, to return to surface of the well. A water hammer pulse is generated each time the self-actuated cyclical flow interruption valve closes, thereby generating an impact force that acts to push the completion equipment distally into the well. The continuous cyclic force of the impact facilitates placement of the completion equipment where desired in the well, including within a horizontal extension of the well. Fluid discharged through the self-actuated cyclical flow interruption valve circulates up to the surface through a vertical and inclined section of the well.

19 Claims, 4 Drawing Sheets

(56) References Cited

U.S. PATENT DOCUMENTS

| | | | | |
|---|---|---|---|---|
| 2,359,629 | A | 10/1944 | Dexter et al. | |
| 2,388,741 | A | 11/1945 | Hays | |
| 2,421,769 | A | 6/1947 | Wolfe | |
| 2,445,803 | A | 7/1948 | Rogers | |
| 2,492,605 | A | 12/1949 | Varney et al. | |
| 2,535,079 | A | 12/1950 | Lebert | |
| 2,543,063 | A | 2/1951 | Rodgers | |
| 2,562,721 | A | 7/1951 | Jakosky | |
| 2,562,724 | A | 7/1951 | Lebert | |
| 2,743,083 | A | 4/1956 | Zublin | |
| 2,855,671 | A | 10/1958 | Lundgren et al. | |
| 2,902,258 | A | 9/1959 | Hildebrant | |
| 2,963,099 | A | 12/1960 | Gianelloni, Jr. | |
| 3,054,595 | A | 9/1962 | Kaufmann | |
| 3,058,510 | A | 10/1962 | Tiraspolsky et al. | |
| 3,065,805 | A | 11/1962 | Martini | |
| 3,433,489 | A | 3/1969 | Wiese | |
| 3,441,094 | A | 4/1969 | Gallo et al. | |
| 3,520,225 | A | 7/1970 | Baugh | |
| 3,568,783 | A | 3/1971 | Chenoweth et al. | |
| 3,603,410 | A | 9/1971 | Angona | |
| 3,606,410 | A | 9/1971 | Inserra | |
| 3,648,786 | A | 3/1972 | Chenoweth | |
| 3,648,789 | A | 3/1972 | Eriksson | |
| 3,655,424 | A | 4/1972 | Orowan | |
| 3,728,040 | A | 4/1973 | Loanesian et al. | |
| 3,741,302 | A * | 6/1973 | Brown | E21B 17/06 166/208 |
| 3,802,515 | A | 4/1974 | Flamand et al. | |
| 3,810,637 | A | 5/1974 | Bonvin | |
| 4,033,429 | A | 7/1977 | Farr | |
| 4,114,703 | A | 9/1978 | Matson, Jr. et al. | |
| 4,190,202 | A | 2/1980 | Yie | |
| 4,196,911 | A | 4/1980 | Matsushita | |
| 4,213,332 | A | 7/1980 | Bonomo et al. | |
| 4,225,000 | A | 9/1980 | Mauer | |
| 4,246,976 | A | 1/1981 | McDonald, Jr. | |
| 4,324,299 | A | 4/1982 | Nagel | |
| 4,418,721 | A | 12/1983 | Holmes | |
| 4,437,525 | A | 3/1984 | O'Hanlon et al. | |
| 4,440,242 | A | 4/1984 | Schmidt et al. | |
| 4,454,935 | A | 6/1984 | Pryor | |
| 4,493,381 | A | 1/1985 | Kajikawa et al. | |
| 4,521,167 | A | 6/1985 | Cavalleri et al. | |
| 4,529,046 | A | 7/1985 | Schmidt et al. | |
| 4,573,637 | A | 3/1986 | Pater et al. | |
| 4,665,997 | A | 5/1987 | Maurer et al. | |
| 4,715,538 | A | 12/1987 | Lingnau | |
| 4,747,544 | A | 5/1988 | Kranzle et al. | |
| 4,762,277 | A | 8/1988 | Pater et al. | |
| 4,790,393 | A | 12/1988 | Larronde et al. | |
| 4,793,435 | A | 12/1988 | Smith et al. | |
| 4,817,739 | A | 4/1989 | Jeter | |
| 4,819,745 | A | 4/1989 | Walter | |
| 4,821,961 | A | 4/1989 | Shook | |
| 4,830,122 | A | 5/1989 | Walter | |
| 4,862,043 | A | 8/1989 | Zieve | |
| 4,863,101 | A | 9/1989 | Pater et al. | |
| 4,890,682 | A | 1/1990 | Worrall et al. | |
| 4,905,775 | A | 3/1990 | Warren et al. | |
| 4,923,120 | A | 5/1990 | Hammelmann | |
| 4,925,510 | A | 5/1990 | Hojo et al. | |
| 4,928,509 | A | 5/1990 | Nakamura | |
| 4,934,254 | A | 6/1990 | Clark et al. | |
| 4,979,577 | A | 12/1990 | Walter | |
| 4,997,159 | A | 3/1991 | Yoshino et al. | |
| 5,000,516 | A | 3/1991 | Kolle et al. | |
| 5,009,272 | A | 4/1991 | Walter | |
| 5,028,004 | A | 7/1991 | Hammelmann | |
| 5,051,020 | A | 9/1991 | Schleicher | |
| 5,121,537 | A | 6/1992 | Matsui et al. | |
| 5,190,114 | A | 3/1993 | Walter | |
| 5,191,557 | A | 3/1993 | Rector et al. | |
| 5,222,425 | A | 6/1993 | Davies | |
| 5,279,262 | A | 1/1994 | Muehleck | |
| 5,319,610 | A | 6/1994 | Airhart | |
| 5,382,760 | A | 1/1995 | Staron et al. | |
| 5,396,965 | A | 3/1995 | Hall et al. | |
| 5,603,385 | A | 2/1997 | Colebrook | |
| 5,646,379 | A | 7/1997 | Hsu et al. | |
| 5,685,487 | A | 11/1997 | Ellis | |
| 5,703,421 | A | 12/1997 | Durkin | |
| 5,740,127 | A | 4/1998 | Van Steenwyk et al. | |
| 5,743,335 | A * | 4/1998 | Bussear | E21B 43/10 166/116 |
| 5,803,188 | A | 9/1998 | McInnes | |
| 5,909,848 | A | 6/1999 | Zink | |
| 5,909,879 | A | 6/1999 | Simpson | |
| 5,938,206 | A | 8/1999 | Klosterman et al. | |
| 5,950,736 | A | 9/1999 | Goldstein | |
| 5,953,809 | A | 9/1999 | Kowalski | |
| 6,027,040 | A | 2/2000 | Frye-Hammelmann | |
| 6,053,261 | A | 4/2000 | Walter | |
| 6,062,311 | A | 5/2000 | Johnson et al. | |
| 6,094,401 | A | 7/2000 | Masak et al. | |
| 6,191,511 | B1 | 2/2001 | Zysset | |
| 6,237,701 | B1 | 5/2001 | Kolle et al. | |
| 6,263,969 | B1 | 7/2001 | Stoesz et al. | |
| 6,301,766 | B1 | 10/2001 | Kolle | |
| 6,347,675 | B1 | 2/2002 | Kolle | |
| 6,394,221 | B2 | 5/2002 | Cosma | |
| 6,453,996 | B1 | 9/2002 | Carmichael et al. | |
| 6,557,856 | B1 | 5/2003 | Azibert et al. | |
| 6,774,519 | B2 | 8/2004 | Pullen et al. | |
| 6,951,262 | B2 | 10/2005 | West | |
| 6,952,068 | B2 | 10/2005 | Gieras et al. | |
| 6,964,270 | B2 | 11/2005 | Janssen et al. | |
| 7,139,219 | B2 * | 11/2006 | Kolle | E21B 47/14 137/105 |
| 7,198,456 | B2 | 4/2007 | Kolle et al. | |
| 7,201,238 | B2 | 4/2007 | Marvin et al. | |
| 7,310,580 | B2 | 12/2007 | Zhou et al. | |
| 7,316,274 | B2 * | 1/2008 | Xu | E21B 43/10 166/208 |
| 7,524,160 | B2 | 4/2009 | Kolle et al. | |
| 7,686,090 | B2 * | 3/2010 | Reimert | E21B 43/10 166/208 |
| 2001/0030486 | A1 | 10/2001 | Pijanowski | |
| 2004/0069530 | A1 | 4/2004 | Prain et al. | |
| 2005/0028797 | A1 | 2/2005 | Janssen et al. | |
| 2005/0178558 | A1 | 8/2005 | Kolle et al. | |
| 2008/0210422 | A1 * | 9/2008 | Clark | E21B 33/124 166/254.2 |
| 2009/0154290 | A1 | 6/2009 | Radtke et al. | |
| 2011/0024653 | A1 * | 2/2011 | Huber | F03G 7/065 251/11 |
| 2012/0132289 | A1 | 5/2012 | Kolle et al. | |
| 2013/0000917 | A1 | 1/2013 | Slack et al. | |
| 2013/0299196 | A1 * | 11/2013 | Kolle | E21B 23/04 166/382 |
| 2015/0101824 | A1 * | 4/2015 | Kolle | E21B 21/10 166/373 |

OTHER PUBLICATIONS

Kolle, Jack K., "A Comparison of Water Jet, Abrasive Jet and Rotary Diamond Drilling in Hard Rock." Presentation for Energy Sources Technology Conference & Exhibition (ETCE '98), Houston, TX: 6pp., Feb. 2-4, 1998.

Kolle, Jack K., "Moving an Ice Mountain." Mechanical Engineering: 49-53, Feb. 1990.

Park, Choon Byong; Miller, Richard D.; Steples, Don W.; and Black, Ross A., "Swept impact seismic techniques (SIST)." Geophysics. vol. 61, No. 6 (Nov.-Dec. 1996): p. 1789-1803. 13 FIGs.

Rector et al., "The use of drill-bit energy as a downhole seismic source." Geophysics vol. 56. No. 5:628-634, May 1991.

* cited by examiner

EXTENDED REACH PLACEMENT OF WELLBORE COMPLETIONS

RELATED APPLICATIONS

The present application claims the benefit of U.S. Provisional Patent Application, Ser. No. 61/672,160 filed on Jul. 16, 2012 and U.S. Non-Provisional Patent Application, Ser. No. 12/957,049 filed on Nov. 30, 2010, each incorporated herein by reference in its entirety.

BACKGROUND

1. Field of the Invention

The present invention relates to placement of wellbore completions.

2. Description of the Related Art

Downhole drilling operations have seen use of well casings for some time. After a well is drilled, casings are inserted into the borehole to provide structural integrity to the borehole. Casings are often made up of sections of steel pipe that connect end-to-end as they are inserted into the borehole. Many wells that are drilled require a casing, and typically as the depth of the well increases, the diameter of successive sections of the casing decreases. A final completion, which may incorporate a casing section, screens, liners, valves or other components, is often required in the producing formation.

Often a borehole that begins as a vertical well will be extended in a horizontal direction, for example, to reach a petroleum reservoir that is disposed in a region laterally offset relative to the vertical portion of the well. In such wells, there is a need to ensure placement of completion equipment in the horizontal portion, and the horizontal extension can be relatively long.

In addition, various types of downhole vibratory tools have been used for through-tubing well intervention operations, including cleaning and milling operations inside liners after they are placed. It would be desirable to provide a specialized tool that can assist in the placement of completion equipment such as liners, screens, valves, patches, plugs, packers, velocity strings, diverters, flow control devices, monitoring equipment, whipstocks or any other equipment in the horizontal portion of a borehole.

SUMMARY OF THE INVENTION

The present invention provides a system and method to facilitate the placement of completion equipment or other similar equipment using a fluid actuated valve that helps push the equipment into the well. The exemplary embodiment of the system facilitates placement of completion equipment using a tool that includes a self-actuated cyclical flow interruption valve as the fluid actuated valve of the system. The self-actuated flow interruption valve can be placed on a deployment tool located at the top of the completion equipment. In the preferred embodiment the tool is releasably attached to the completion equipment. The valve and attached completion equipment are placed in position downhole, fluid is then pumped though the self-actuated flow interruption valve and vented to return to surface. The pulse that is generated when the self-actuated flow interruption valve closes creates an impact that acts to push the completion equipment distally into the well.

BRIEF DESCRIPTION OF THE DRAWINGS

Various aspects and attendant advantages of one or more exemplary embodiments and modifications thereto will become more readily appreciated as the same becomes better understood by reference to the following detailed description, when taken in conjunction with the accompanying drawings, wherein.

DETAILED DESCRIPTION

Figure 2A:
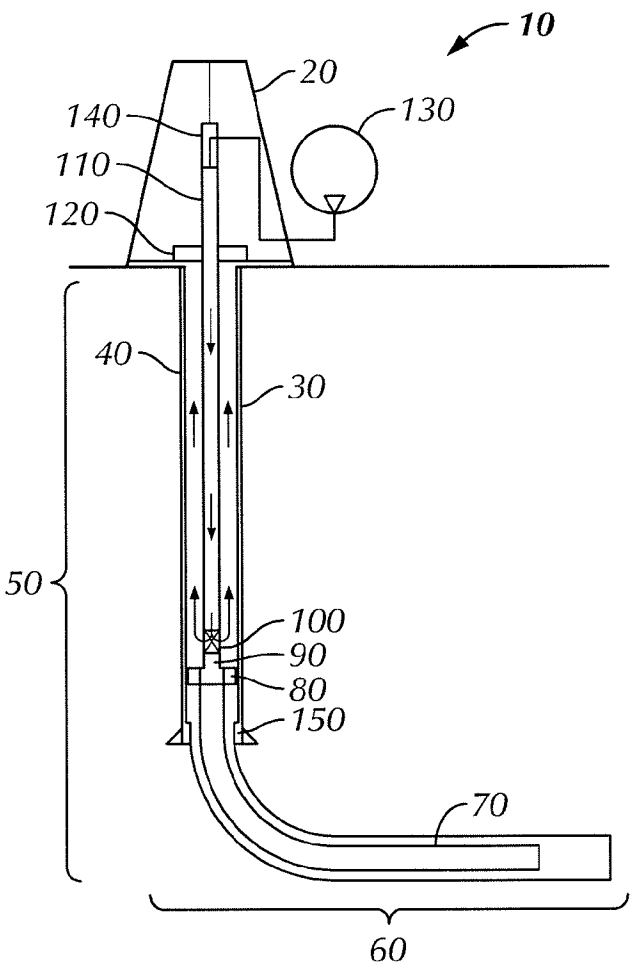
FIG. 2A is a schematic cross-sectional view of an exemplary system for extended reach completion placement including a self-actuated cyclical flow tool showing a pulse valve in the open state during completion placement.

Exemplary embodiments are illustrated in referenced Figures of the drawings. It is intended that the embodiments and Figures disclosed herein are to be considered illustrative rather than restrictive. No limitation on the scope of the technology that follows is to be imputed to the examples shown in the drawings and discussed herein.

The present invention provides a system and method to facilitate the placement of completion equipment or other similar equipment using a fluid-actuated valve that helps push the equipment into the well. The exemplary embodiment of the system facilitates placement of completion equipment using a tool that includes a self-actuated cyclical flow interruption valve as the fluid-actuated valve of the system. The self-actuated flow interruption valve can be placed on a deployment tool located at the top of the completion equipment. The completion equipment is fed into the well using deployment tubing. Fluid is then pumped though the self-actuated flow interruption valve and vented immediately below the valve to return to surface. The "water hammer pulse" that is generated when the self-actuated flow interruption valve closes creates an impact that acts to push the completion equipment distally into the well. Fluid discharged through the tool circulates up the vertical and inclined sections of the well, which is typically a larger diameter cased hole than the completion that is being placed. A portion of the flow, such as may be required for hole conditioning and lubrication, could be pumped into the liner during this procedure. The flow into the completion would be limited to prevent premature actuation of any pressure actuated completion equipment, such as packers and sleeve valves.

In an exemplary embodiment of this tool, a self-piloted hydraulic valve, such as described in U.S. Pat. Nos. 6,237,701 and 7,139,219, U.S. patent application No. 12/957,049, and in other commonly assigned pending patent applications, can be included on a deployment tool that is disposed on top of the liner. U.S. patent application No. 12/957,049 is herein incorporated by reference. However, it is not intended that the tool be limited to use of the self-piloted hydraulic valve disclosed in these patents, since other types of self-actuated fluid valves can alternatively be used to create water hammer pulses or vibration.

Figure 1:
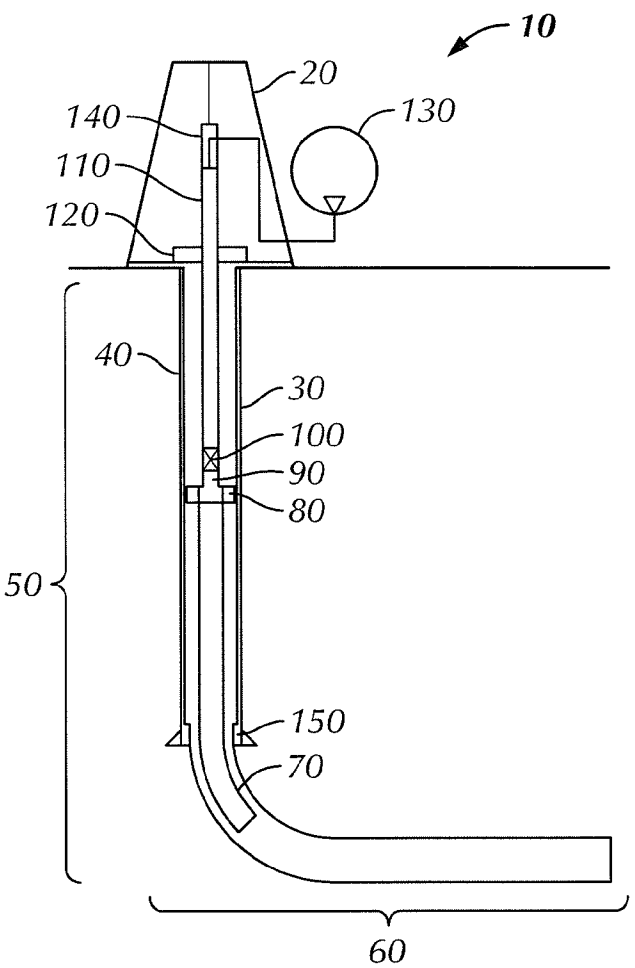
FIG. 1 is a schematic cross-sectional view of an exemplary system for extended reach completion placement including a self-actuated cyclical flow tool.

Referring to FIG. 1, the system for extended reach deployment 10 is shown during deployment from a drill rig 20. The completion may incorporate equipment such as screens, perforated tubing, casing and multistage fracture completions containing multiple sliding valves and ball seats any of which may be deployed by such a system. The system is designed to overcome the challenges of inserting the completion into an extended-reach horizontal openhole and into deviated wells with a tortuous wellpath including toe-up or high dogleg severity where sliding friction can hamper full deployment of the completion. The completion must generally be deployed through casing 30 that extends from surface to some depth. FIG. 1 shows a well that is cased 40 in the vertical section 50 with an openhole curve and horizontal section 60, but more complex geometries, including multiple telescopic casing strings, are common and this figure is not meant to be limiting in regard to well geometry.

The completion 70 is supported by a liner hanger 80 that is designed to latch into and seal with a casing profile 150 at the bottom of the casing 40. In the preferred embodiment, the liner hanger 80 is coupled to a release mechanism 90 just below a self-actuated cyclic flow interruption valve or impulse valve 100. Also in a preferred embodiment, this valve is of the pilot and poppet design disclosed in U.S. patent application No. 12/957,049. The valve is in turn supported on a deployment string 110 typically comprising joints of tubing that are deployed into the well by a drill rig 20 as shown or a workover rig or by a continuous string of coiled tubing. The deployment string 110 may include a section of heavy walled tubing to provide additional weight to push the completion though the curve and into the horizontal section of the well 50. These rigs include a rotary table 120 as shown or a top drive that is capable of rotating the deployment string 110. Fluid pumps 130 are provided and are connected to supply fluid to the deployment string 110 through a swivel 140. A coiled tubing rig may also be employed although this equipment does not allow rotation of the deployment string.

FIG. 1 shows the system 10 being lowered into a well with the completion 70 part way through the curved section of the openhole with no fluid flowing. Friction forces increase as the completion 70 enters the curve and horizontal section and the weight of the deployment string 110 may not be sufficient to push the completion 70 to bottom. At this point fluid can be pumped by pump 130 though swivel 140 and through the deployment string 110 as shown by arrows in FIG. 2A. The fluid flows through the pulse valve 100 and is discharged into the well above the release mechanism 90 to return to surface. Although not shown, some flow may also be discharged into the completion for well conditioning. Surface valves and equipment for handling the return flow are well known and are not shown.

Figure 2B:
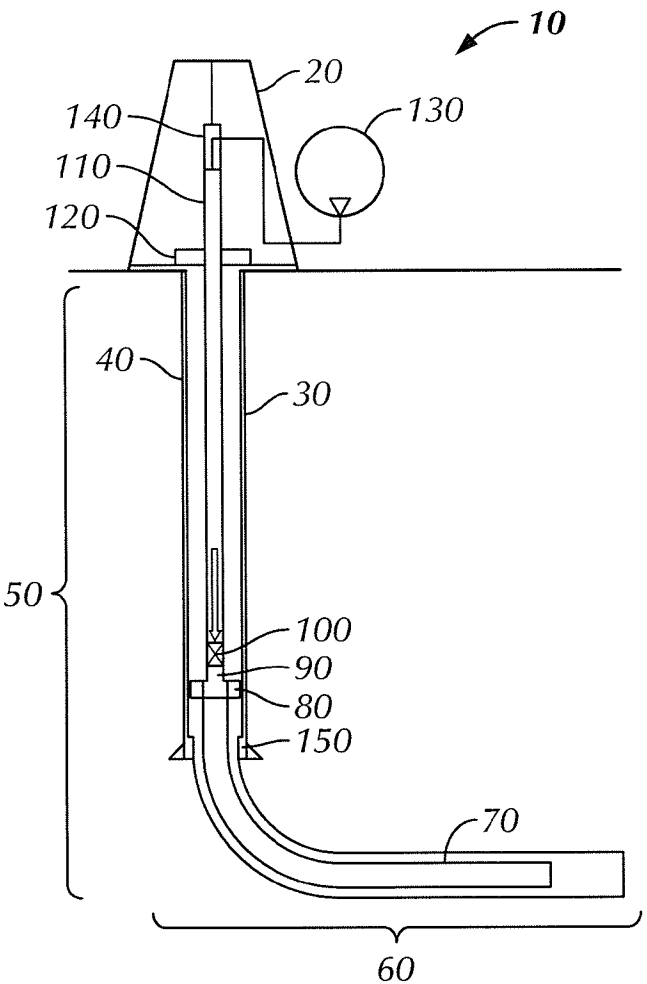
FIG. 2B is a schematic cross-sectional view of an exemplary system for extended reach completion placement including a self-actuated cyclical flow tool showing a pulse valve in the closed state during completion placement.
Figure 7:
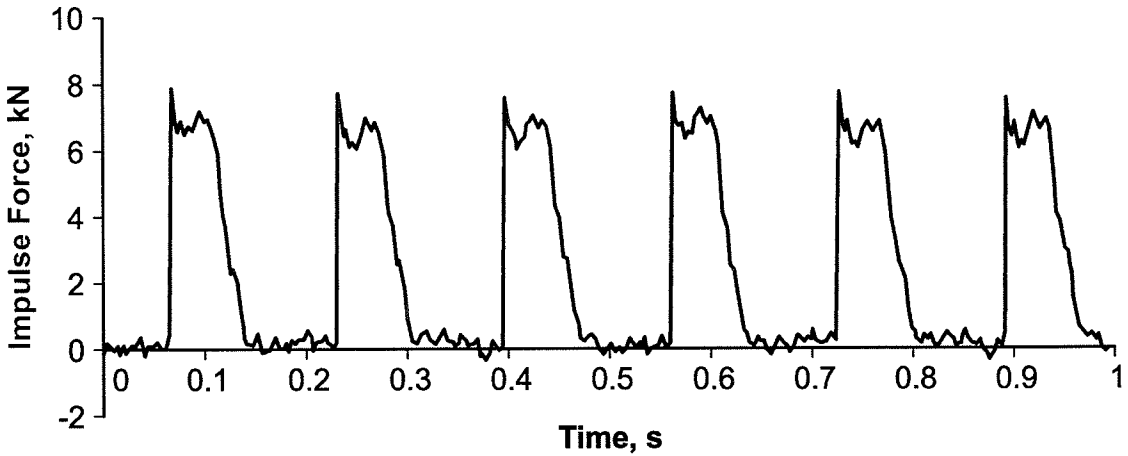
FIG. 7 shows an example of a water hammer impulse force time history of a system for extended reach completion placement.

FIG. 2A shows the pulse valve 100 in the open position with all fluid being discharged. FIG. 2B shows the impulse valve 100 in the closed position. Closing the valve 100 stops the flow of fluid and results in a water hammer impulse force shown by the large open arrow acting downwards at the valve 100. The water hammer impulse force is proportional to the mass flow rate of the fluid. An example of the cyclic impulse forces generated by the valve 100 as described in U.S. patent application No. 12/957,049, with a 2-78" outer diameter, and while operating at 3 bbl per minute water flow rate, is shown in FIG. 7. The cyclic impulse forces act on the top of the completion 70 and drive it into the well.

Figure 3:
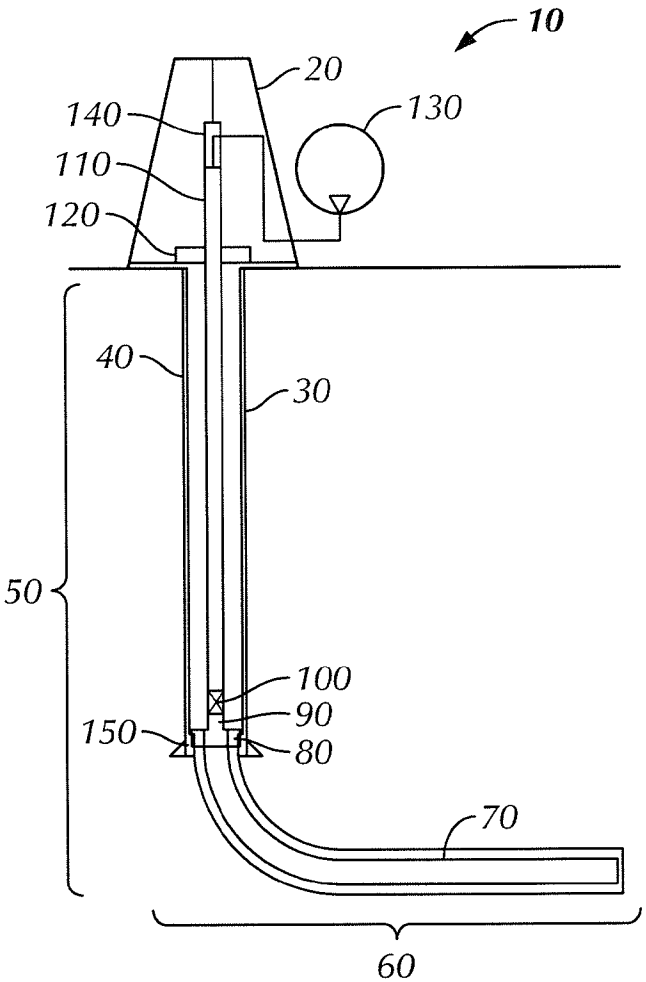
FIG. 3 is a schematic cross-sectional view of an exemplary system for extended reach completion placement including a self-actuated cyclical flow tool showing the completion after landing the liner hanger at the bottom of the casing.
Figure 5:
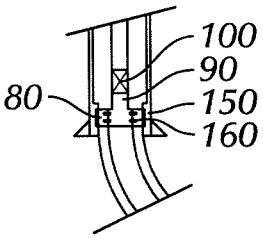
FIG. 5 is an enlarged cross-sectional view of a shear pin release mechanism of an exemplary system for extended reach completion placement.
Figure 6:
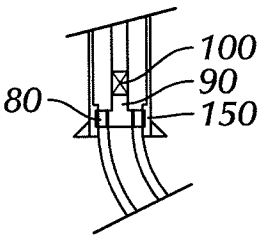
FIG. 6 is an enlarged cross-sectional view of a reverse thread release mechanism of an alternate system for extended reach completion placement.
Figure 4:
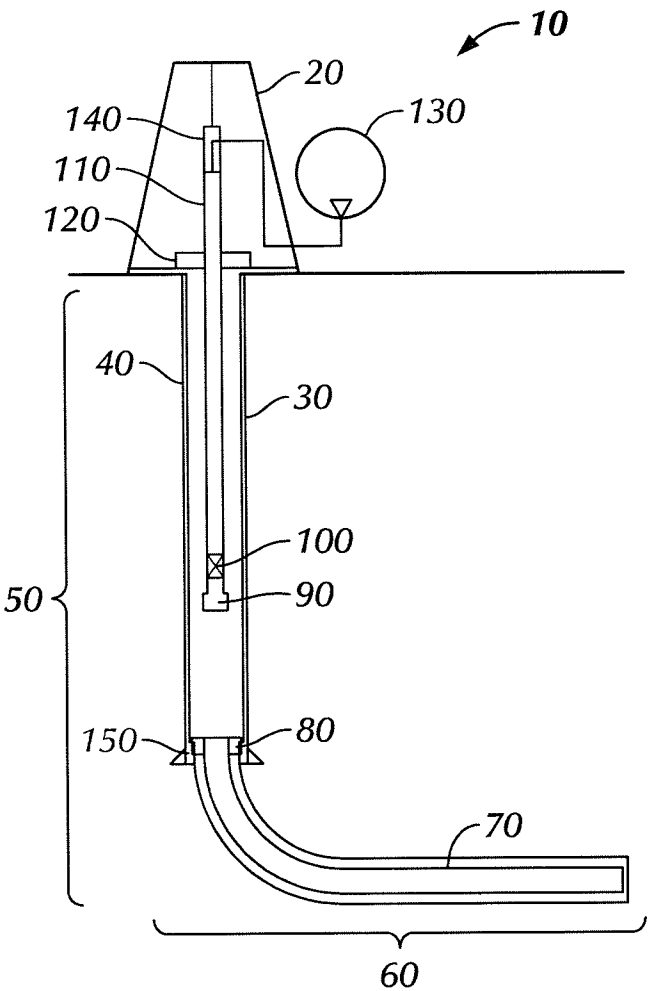
FIG. 4 is a schematic cross-sectional view of an exemplary system for extended reach completion placement including a self-actuated cyclical flow tool showing the retrieval of the deployment tools.

FIG. 3 shows the completion 70 after it has reached bottom. At this point the liner hanger 80 engages the casing profile 150 and latches in place to prevent reverse motion or rotation. The design of liner hangers 80 and casing profiles 150 are well known and not described in detail here. A variety of liner hangers 80 and casing profiles 150 may be deployed depending on the well requirements. Referring to FIG. 3, fluid pumping has stopped and the deployment string is now released using the release mechanism 90. A shear pin type of release mechanism 90 is shown in FIG. 5. Once the liner hanger 80 is latched, overpull on the deployment string 110 will shear the pins 160 and allow retrieval of the deployment string 110, pulse valve 100 and release mechanism 90 as shown in FIG. 4. The release mechanism 90 may also incorporate reverse, left hand, threads to engage the liner hanger 80 as shown in FIG. 6. For this embodiment, right-handed rotation of the deployment string 110 will disengage the release mechanism 90 from the liner hanger 80 and allow retrieval to surface. More complex latch and release mechanisms are also in common use for tool release of the completion and may be employed to release the deployment string 110. The two options shown here are not meant to be limiting as other release mechanisms may be deployed with the extended reach deployment system 10.

Other exemplary embodiments (not shown) can use a plurality of fluid-actuated valves that are designed to interrupt the flow of fluid though tubing and to then impart an impact or cause a vibration due to the resulting water hammer effect. Multiple tools of this type can also be placed at different levels in the deployment string to increase the action of the tools.

Although the concepts disclosed herein have been described in connection with one or more exemplary form of practicing them and modifications thereto, those of ordinary skill in the art will understand that many other modifications can be made thereto. Accordingly, it is not intended that the scope of these concepts in any way be limited by the above description.

What is claimed is:

1. A method for placing a completion into an openhole section of well below a well casing, comprising the steps of:

(a) inserting a completion string connected to a liner hanger having a release mechanism section into a well, (b) inserting a flow cycling valve connected to a deployment string into a well, (c) activating a fluid pump on the surface to pump fluids downhole to the flow cycling valve disposed proximally of the completion string to generate one or more pressure pulses, (d) applying the force caused by the one or more pressure pulses to advance the completion distally into the well until the flow cycling valve and the liner hanger encounter a casing profile, and (e) causing the release mechanism to release from the liner hanger, thereby completing the placement of the completion in the well.

2. The method for placing a completion into an openhole section of well below a well casing as described in claim 1, further comprising the step of:

(a) latching the liner hanger when it encounters the casing profile, and (b) causing the release mechanism, where the release mechanism is a shear pin release type, to release by creating overpull on the deployment string.

3. The method for placing a completion into an openhole section of well below a well casing as described in claim 1, further comprising the step of:

(a) latching the liner hanger when it encounters the casing profile, and (b) causing the release mechanism, where the release mechanism is a reverse, left hand thread release type, to release by rotating the deployment string.

4. The method for placing a completion into an openhole section of well below a well casing as described in claim 1, further comprising the step of:

(a) removing the deployment string connected to the flow cycling valve and a released portion of the release mechanism, thereby completing the completion installation in the well.

5. The method for placing a completion into an openhole section of well below a well casing as described in claim 1, wherein the flow cycling valve is a pulse valve.

6. The method for placing a completion into an openhole section of well below a well as described in claim 5, wherein the pulse valve is a pilot and poppet water hammer valve.

7. A system for placing a completion into an openhole section of well below a well casing, comprising:

a completion string connected to a liner hanger having a release mechanism section, a flow cycling valve connected to a deployment string and disposed proximally of the completion string, and a fluid pump on the surface to pump fluids downhole to the flow cycling valve to thereby generate one or more pressure pulses, the flow cycling valve positioned so the force of the pulses serves to advance the completion distally into the well.

8. The system of claim 7 wherein the release mechanism section is a shear pin type release mechanism and the release mechanism section is disposed between the completion and the flow cycling valve.

9. The system of claim 8 wherein said release mechanism is coupled to the completion with shear pins and the external features on proximal end of the completion engage features on distal end of the casing thereby preventing axial motion of the completion.

10. The system of claim 7 wherein the release mechanism section incorporates a reverse thread that engages the completion and external features on the proximal end of the completion that engage features at the end of the casing thereby preventing rotation of the completion but allowing for the rotation a releasable portion of the release mechanism section.

11. The system of claim 7 wherein the flow cycling valve is a pilot and poppet water hammer valve.

12. A system for placing a completion into an openhole section of well below a well casing, comprising:

a completion string connected to a liner hanger having a release mechanism section, a pulse valve connected to a deployment string and disposed proximally of the completion string, and a fluid pump on the surface to pump fluids downhole to the pulse valve to thereby generate one or more pressure pulses, the pulse valve positioned so the force of the pulses serves to advance the completion distally into the well.

13. The system of claim 12 wherein the release mechanism section is a shear pin type release mechanism and the release mechanism section is disposed between the completion and the pulse valve.

14. The system of claim 13 wherein said release mechanism is coupled to the completion with shear pins and the external features on proximal end of the completion engage features on distal end of the casing thereby preventing axial motion of the completion.

15. The system of claim 13 wherein the pilot and poppet water hammer valve is configured such that the poppet is reciprocally moveable between a closed position, in which it at least partially blocks pressurized fluid flow from the fluid pump on the surface from flowing through a poppet seat of the poppet, and an open position, in which pressurized fluid flows through the throat of the poppet seat, the valve creating a pressure pulse each time the poppet moves to the closed position.

16. The system of claim 12 wherein the release mechanism section incorporates a reverse thread that engages the completion and external features on the proximal end of the completion that engage features at the end of the casing thereby preventing rotation of the completion but allowing for the rotation a releasable portion of the release mechanism section.

17. The system of claim 12 wherein the pulse valve is a pilot and poppet water hammer valve.

18. The system of claim 12 further comprising a swivel allowing for rotation of the deployment string.

19. The system of claim 12 further comprising a casing profile, the liner hanger configured to latch on the casing profile as the completion string reaches an installation position in the well.

* * * * *